US012209482B2

(12) United States Patent
Olson

(10) Patent No.: US 12,209,482 B2
(45) Date of Patent: Jan. 28, 2025

(54) WELL ABANDONMENT TOOL

(71) Applicant: Brett Olson, Medicine Hat (CA)

(72) Inventor: Brett Olson, Medicine Hat (CA)

( * ) Notice: Subject to any disclaimer, the term of this patent is extended or adjusted under 35 U.S.C. 154(b) by 225 days.

(21) Appl. No.: 17/748,851

(22) Filed: May 19, 2022

(65) Prior Publication Data

US 2022/0372825 A1 Nov. 24, 2022

Related U.S. Application Data

(60) Provisional application No. 63/190,549, filed on May 19, 2021.

(51) Int. Cl.

| | |
|---|---|
| ***E21B 33/134*** | (2006.01) |
| ***E21B 17/06*** | (2006.01) |
| ***E21B 23/06*** | (2006.01) |
| ***E21B 33/129*** | (2006.01) |
| ***E21B 33/13*** | (2006.01) |

(52) U.S. Cl.

CPC ..... *E21B 33/134* (2013.01); *E21B 23/06* (2013.01); *E21B 17/06* (2013.01); *E21B 33/1293* (2013.01); *E21B 33/1294* (2013.01); *E21B 33/13* (2013.01)

(58) Field of Classification Search

CPC ..... E21B 33/134; E21B 23/06; E21B 17/06; E21B 33/1293; E21B 33/1294; E21B 33/13

See application file for complete search history.

(56) References Cited

U.S. PATENT DOCUMENTS

| | | | | | |
|---|---|---|---|---|---|
| 2,653,666 | A * | 9/1953 | Baker | E21B 27/02 | 166/63 |
| 2,703,622 | A * | 3/1955 | Austin | E21B 33/1293 | 166/241.5 |
| 2,713,907 | A * | 7/1955 | Kline | E21B 23/065 | 166/63 |
| 2,815,817 | A * | 12/1957 | Conrad | E21B 33/134 | 277/333 |
| 3,000,443 | A * | 9/1961 | Thompson | E21B 23/06 | 166/123 |
| 3,061,013 | A * | 10/1962 | Thomas, Jr. | E21B 33/128 | 166/134 |
| 3,160,209 | A * | 12/1964 | Bonner | E21B 23/065 | 92/9 |
| 3,285,343 | A * | 11/1966 | Urbanosky | E21B 33/1293 | 166/134 |

(Continued)

*Primary Examiner* — Christopher J Sebesta
*Assistant Examiner* — Neel Girish Patel
(74) *Attorney, Agent, or Firm* — Husch Blackwell LLC

(57) ABSTRACT

An abandonment tool for abandoning a well is provided. The tool can have a cement tool connectable to coiled tubing for controlling a flow of a cement slurry through the tool, a setting tool provided below the cement tool for setting a bridge plug, an upper shear joint connected between the cement tool and the setting tool, a shear stud connecting the bridge plug to the setting tool, and at least one exhaust port in an inner passage to place the inner passage in fluid communication with an annulus between the abandonment tool and a wall of the well after the bridge plug has plugged the well. The upper shear joint shearing at a first force to separate the cement tool and the setting tool and the shear stud shearing at a second force to separate the bridge plug from the setting tool.

10 Claims, 11 Drawing Sheets

(56) References Cited

U.S. PATENT DOCUMENTS

| | | | | | |
|---|---|---|---|---|---|
| 3,503,445 | A * | 3/1970 | Cochrum | E21B 21/103 | 166/151 |
| 4,583,593 | A * | 4/1986 | Zunkel | E21B 33/1294 | 166/131 |
| 4,784,226 | A * | 11/1988 | Wyatt | E21B 33/1293 | 166/182 |
| 5,813,458 | A * | 9/1998 | Smith, Jr. | E21B 23/06 | 166/182 |
| 9,951,579 | B2 * | 4/2018 | Jones | E21B 33/1293 | |
| 10,538,981 | B2 * | 1/2020 | Covalt | E21B 23/065 | |
| 10,927,627 | B2 * | 2/2021 | Eitschberger | E21B 23/06 | |
| 2007/0151722 | A1 * | 7/2007 | Lehr | E21B 23/06 | 166/123 |
| 2008/0314591 | A1 * | 12/2008 | Hales | E21B 33/124 | 166/285 |
| 2009/0173489 | A1 * | 7/2009 | Bullard | E21B 23/06 | 166/192 |
| 2013/0168078 | A1 * | 7/2013 | McCarter | E21B 31/007 | 166/99 |
| 2015/0007980 | A1 * | 1/2015 | Frazier | E21B 17/10 | 166/135 |
| 2015/0090439 | A1 * | 4/2015 | VanLue | E21B 34/16 | 166/138 |
| 2018/0080298 | A1 * | 3/2018 | Covalt | E21B 23/065 | |
| 2020/0347694 | A1 * | 11/2020 | Power | E21B 23/06 | |
| 2021/0404285 | A1 * | 12/2021 | Reyes Villegas | E21B 33/1292 | |
| 2022/0298883 | A1 * | 9/2022 | Mhaskar | E21B 33/129 | |
| 2023/0056451 | A1 * | 2/2023 | Jacob | E21B 33/1285 | |
| 2023/0103389 | A1 * | 4/2023 | Coffey | E21B 43/26 | 166/135 |
| 2024/0110464 | A1 * | 4/2024 | Skeels | E21B 41/0064 | |

* cited by examiner

WELL ABANDONMENT TOOL

CROSS-REFERENCE TO RELATED APPLICATION

The present application claims the benefit of U.S. Provisional Application No. 63/190,549 entitled "WELL ABANDONMENT TOOL", filed May 19, 2021, which is incorporated herein by reference in its entirety.

TECHNICAL FIELD

The present invention relates to a tool to place a cement plug in a well to be abandoned and, more particularly, a single downhole tool that allows the cement plug to be placed in the well and pressure tested.

BACKGROUND

When an oil or gas well is no longer needed, such as when it is dry and gas or oil can no longer be produced from the well, typically, the well must be permanently sealed and taken out of service. This is commonly known as abandonment.

To seal the well, one or more cement plugs are placed in the well to permanently seal off the well. The cement plug is placed in the well by installing a bridge plug in the well and then directing a cement slurry downhole onto the bridge plug to set in the well and form the cement plug. If the well contains more than one zone a number of cement plugs will likely have to be installed in the well. The lowest cement plug can prevent any fluids migrating from the well into underground freshwater sources and polluting them. Cement plugs placed between zones can prevent zonal communication or migration of fluids between zones.

To set a cement plug, a bridge plug must be installed in the well and then a cement slurry must be directed downhole and then held in place on top of the bridge plug until the cement slurry sets into a cement plug. Additionally, once the cement slurry is placed in the well, the well must be pressurized to test the fitness of the cement plug. This typically takes multiple trips downhole with different tools to set the bridge plug, direct cement slurry onto the bridge plug, and test it.

SUMMARY

In an aspect, an abandonment tool for abandoning a well is provided. The abandonment tool having a cement tool connectable to coiled tubing for controlling a flow of a cement slurry through the abandonment tool, a setting tool provided below the cement tool, an upper shear joint connected below the cement tool and above the setting tool, the upper shear joint shearing at a first force to separate the cement tool and the setting tool, a bridge plug for plugging the well, the bridge plug settable by the setting tool, a shear stud connecting the bridge plug to a bottom end of the setting tool, the shear stud shearing at a second force to separate the bridge plug from the setting tool, and at least one exhaust port in an inner passage in the abandonment tool to place the inner passage in fluid communication with an annulus between the abandonment tool and a wall of the well after the bridge plug has plugged the well. The second force can be lower than the first force.

In a further aspect, the cement tool can have an upper end connectable to coiled tubing, a lower end, an outer sleeve forming an outer surface of the cement tool, an inner passage running axially through the cement tool with an inlet in the upper end of the cement tool, a cement drain sleeve having at least one cement drain, an annulus formed between an exterior of the cement drain sleeve and the inner surface of the outer sleeve, the annulus in fluid communication with an outlet in the lower end of the cement tool, and a cement piston provided in the inner passage and having at least one cement port in fluid communication with the inner passage, the cement piston displaceable from an initial top position to a bottom position. When the cement piston is in the initial top position, the cement drain sleeve covers the at least one cement port and when the cement position is displaced to the bottom position, the at least one cement port aligns with the at least one cement drain, placing the inner passage of the cement tool in fluid communication with the annulus.

In a further aspect, the setting tool can have an upper end, a lower end, an inner passage running axially through the setting tool from an inlet in the upper end of the setting tool and surrounded by an outer wall, a setting sleeve for setting the bridge plug and shearing the shear stud to separate the bridge plug, a series of pistons provided in the inner passage for creating the force on the setting sleeve. The at least one exhaust port is provided in the outer wall to place the inner passage in fluid communication with a well annulus between an outer surface of the setting tool and a wall of the well and the at least one exhaust port is positioned below where a piston in the series of pistons is initially positioned and downward displacement of the series of pistons uncovers the at least one exhaust port.

BRIEF DESCRIPTION OF THE DRAWINGS

A preferred embodiment of the present invention is described below with reference to the accompanying drawings, in which.

DETAILED DESCRIPTION OF THE DRAWINGS

Figure 1:
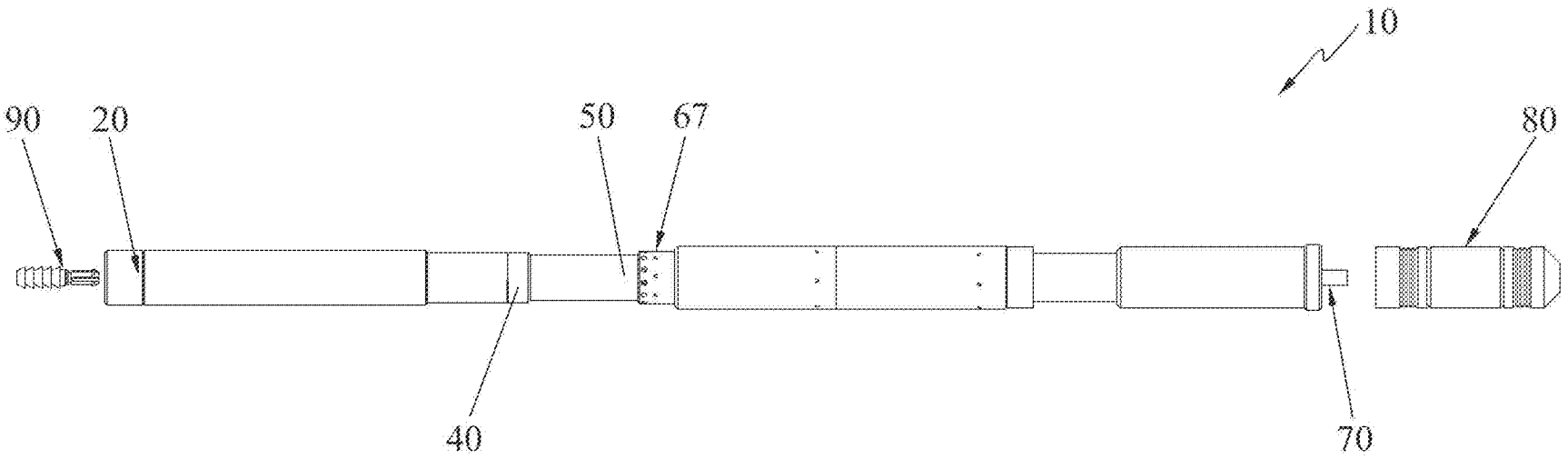
FIG. 1 is a side view of an abandonment tool for placing a cement plug downhole in a well.

FIG. 1 illustrates a single zone abandonment tool 10 which can be used to install a cement plug in a well. The abandonment tool 10 can be used when the well has a single zone to place a cement plug above the single zone to prevent fluids, such as gas and/or oil, from the zone migrating into the water table or out into the atmosphere. The single zone abandonment tool 10 can include: a cement tool 20; an upper shear joint 40; a setting tool 50; exhaust ports 67; a shear stud 70; a bridge plug 80; and a dart 90.

The cement tool 20 can be connected to coiled tubing that will be run down a well to be abandoned. The setting tool 50 can be connected by the upper shear joint 40 to the cement tool 20 so that the setting tool 50 is positioned below the cement tool 20 when the tool 10 is run down a well and cement slurry flowing out of the cement tool 20 can flow through the upper shear joint 40 to the setting tool 50. The setting tool 50 can be used to set the bridge plug 80 that is connected to the setting tool 50 by the shear stud 70. The dart 90 is placed in the coiled tubing before an amount of cement slurry, based on the amount of cement that is desired for the cement plug in the well, so that the dart 90 enters the cement tool 20 behind the cement slurry as it passes through the cement tool 20 and seats inside the cement tool 20, blocking the cement tool 20 when the desired amount of cement slurry has been placed in the well to form the cement plug.

Figure 3:
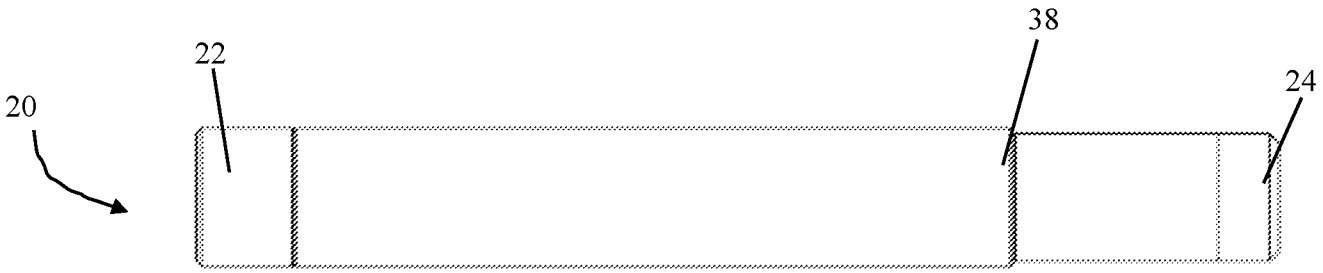
FIG. 3 is a side view of a cement tool that can be used in the abandonment tool.
Figure 4:
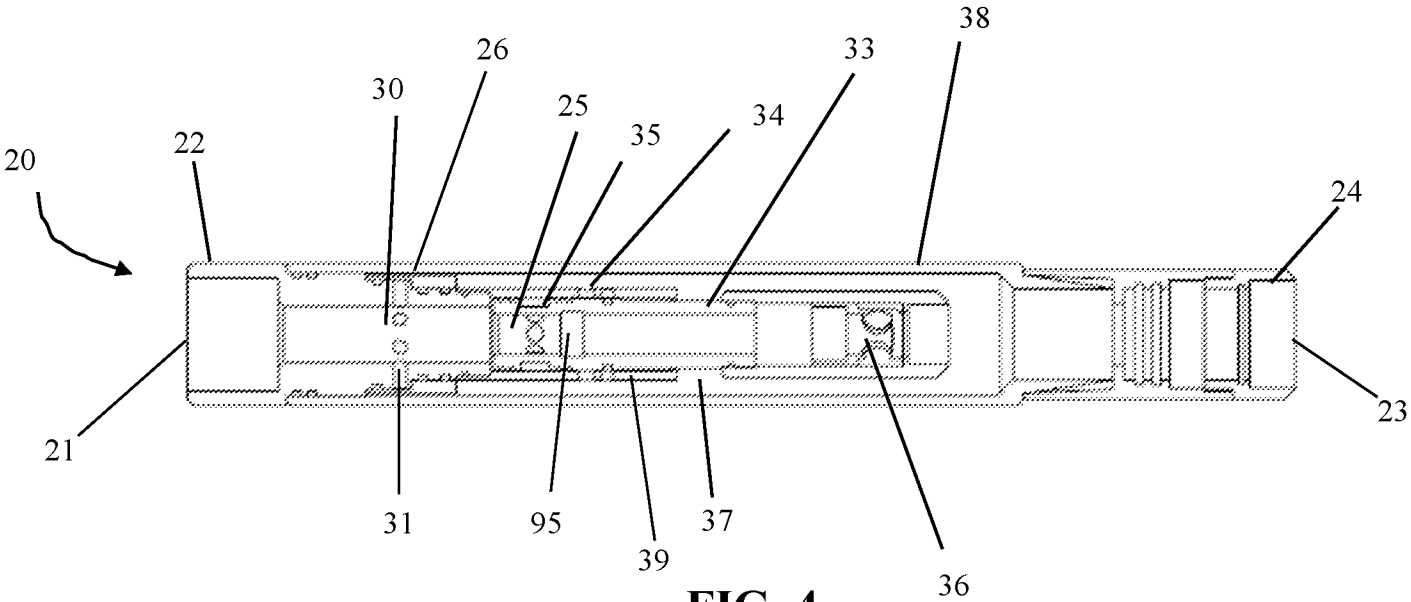
FIG. 4 is a schematic view of an interior of the cement tool of FIG. 3, showing the interior of the cement tool.

The cement tool 20 is on the upper end of the abandonment tool 10 and the cement tool 20 is used to control the flow of cement slurry from the coiled tubing so that the cement slurry initially flows into the setting tool 50, that sets the bridge plug 80 in place in the well, using this flow of cement slurry and then the cement tool 20 can change the flow of the cement slurry so that the cement slurry flows on top of the set bridge plug 80 to form a cement plug in the well. Referring to FIGS. 3 and 4, the cement tool 20 can have: an upper end 22; a lower end 24; an inner passage 25; a circulation sleeve 26; a circulation sub 30; circulation ports 31; a cement piston 33; cement drains 34; cement ports 35; a check valve 36; an annulus 37; an outer sleeve 38; a cement drain sleeve 39; a dart seat 95.

The upper end 22 of the cement tool 20 is connected to coiled tubing that is run down the well so that cement slurry can flown down the coiled tubing and into the cement tool 20. At the upper end 22 of the cement tool 20 the circulation sub 30 can be provided. Below the circulation sub 30, the cement drains 34 can be provided, with the check valve 36 positioned below the cement drains 34.

The outer sleeve 38 surrounds the components of the cement tool 20 and forms an outer surface of the cement tool 20.

The inner passage 25 of the cement tool 20 can pass axially through the cement tool 20 from the upper end 22 of the cement tool 20 with the inner passage 25 having an inlet 21 at the upper end 22 of the cement tool 20. The cement piston 33 can be provided in the inner passage 25 so that cement that flows into the inner passage 25 from the top end 22 of the cement tool 20 through the inlet 21 will flow up against the cement piston 33. Cement introduced by coiled tubing connected to the upper end 22 of the cement tool 20 can flow through this inner passage 25 in the cement tool 20 and up against the cement piston 33.

The check valve 36 is provided within inner passage 25 of the cement tool 20 to stop cement flowing through the inner passage 25 and out the lower end 24 of the cement tool 20. The check valve 36 is used so that cement slurry can be pumped into the lower end 24 of the cement tool 20 so this cement slurry can flow up the cement tool 20 and into the lower end of coiled tubing connected to upper end 22 of the cement tool 20. The check valve 36 allows the cement slurry to be pumped into and up the cement tool 20. However, when the desired amount of cement slurry has been pumped up the cement tool 20 and into the bottom of the coiled tubing, the check valve 36 will close and prevent the cement slurry from sliding back down and out of the lower end 24 of the cement tool 20.

The cement drains 34 can allow cement in the inner passage 25 of the cement tool 20 to flow from the inner passage 25, through the cement ports 35 in the walls of the cement piston 33, out of the cement drains 34 and into an annulus 37 formed between the exterior of the cement drain sleeve 39 and the inner surface of the outer sleeve 38 when the cement ports 35 are aligned with the cement drains 34. The annulus 37 is in fluid communication with the lower end 24 of the cement tool 20 and an outlet 23 at the lower end 24 of the cement tool 20. The cement ports 35 are provided passing out of inner passage 25 and covered with the cement drain sleeve 39 when the cement piston 33 is in an upper position. When the cement slurry in the inner passage 25 is placing enough downward force on the cement piston 33, the cement piston 33 can be displaced downwards to a lower position, which in turn will displace the cement ports 35 downwards. At the bottom position of the downwardly displaced cement piston 33, the downwardly displaced cement ports 35 can align with cement drains 34 in the cement drain sleeve 39; exposing the cement ports 35. This will place the inner passage 25 of the cement tool 20 in fluid communication with the annulus 37 through the cement ports 35 and the cement drains 34.

The circulation sub 30 at the upper end 22 of the cement tool 20 is used to pressurize the well to test the cement plug after it has been set in the well. The inner passage 25 in the cement tool 20 is sized to receive the dart 90 in a dart seat 95, when the dart 90 is forced into the inner passage 25 of the cement tool 20.

The circulation sub 30 can have circulation ports 31 exiting out of the inner passage 25 that are covered with a circulation sleeve 26. However, by applying pressure to the dart 90 when it is seated in the dart seat 95, the circulation sleeve 26 can be shifted or displaced downwards, exposing the circulation ports 31 and placing the inner passage 25 in fluid communication with the annulus 37 through the circulation ports 31. With the inner passage 25 in fluid communication with the annulus 37, the coiled tubing can be pressurized, which will pressurize the annulus 37 and the well above the cement plug.

Figure 2:
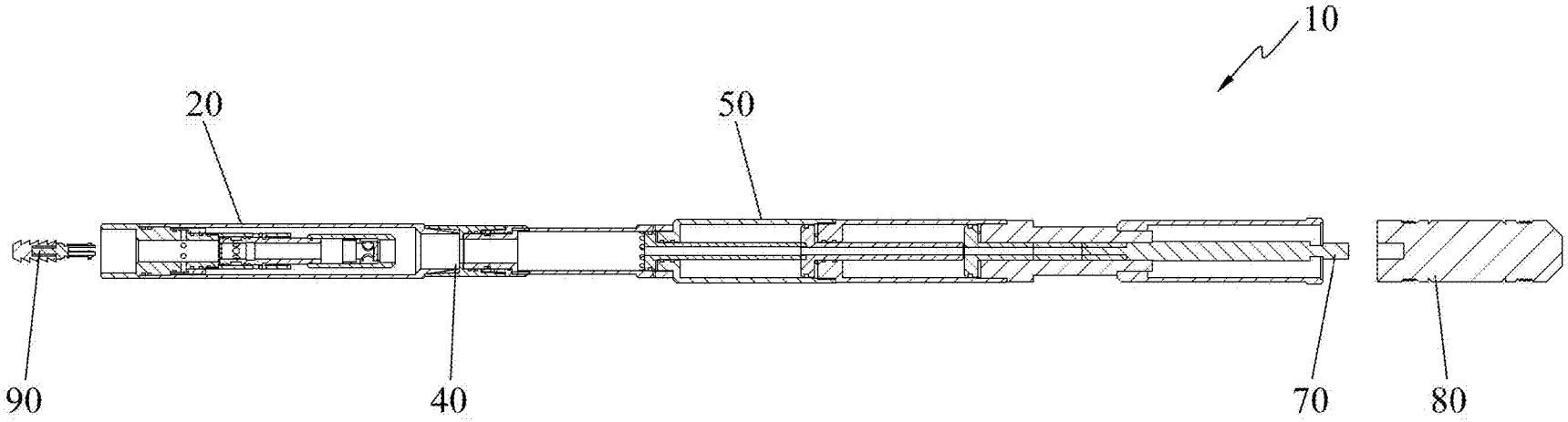
FIG. 2 is a schematic view of an interior of the abandonment tool of FIG. 1 showing the interior of the abandonment tool.

Referring again to FIGS. 1 and 2, the setting tool 50 is connected below the cement tool 20 by the upper shear joint 40. This upper shear joint 40 can be designed to shear at a first force so that if force greater than this first force is applied to the upper shear joint 40, the upper shear joint 40 will separate causing the setting tool 50 to separate from the cement tool 20. In one aspect, this first force that the upper shear joint 40 will shear and separate at is 20,000 lbs.

Figure 5:
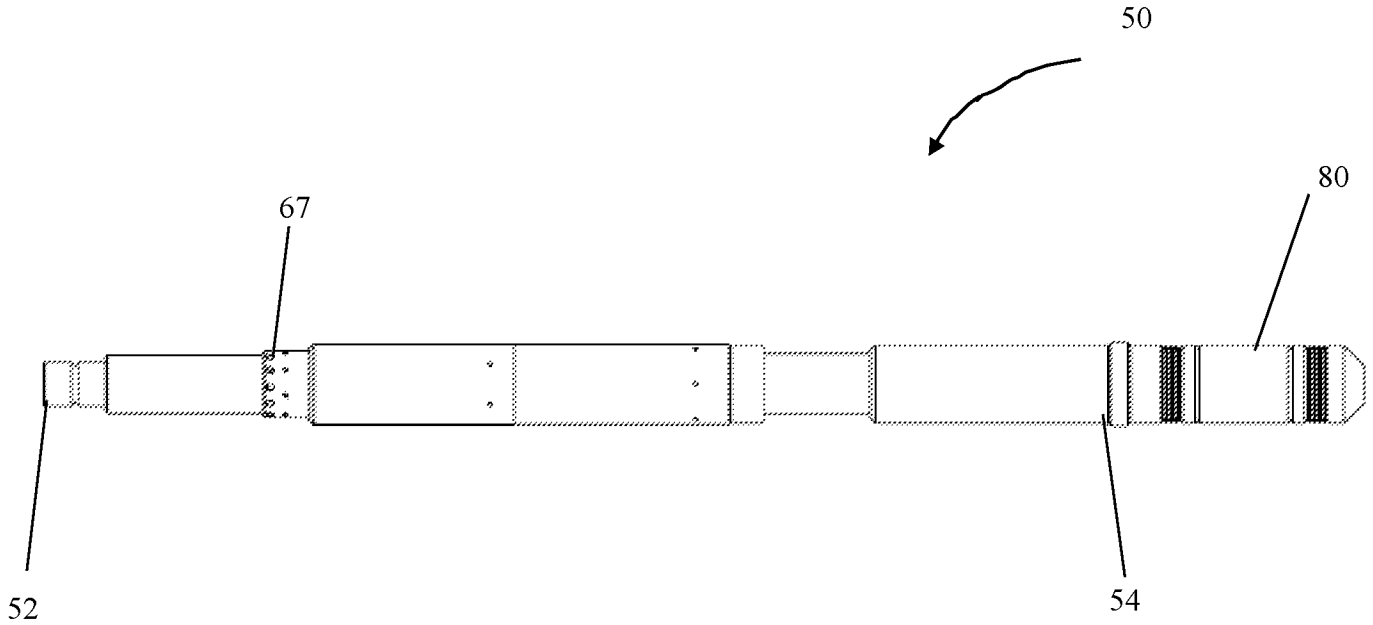
FIG. 5 is a side view of a setting tool and bridge plug that can be used in the abandonment tool.
Figure 6:
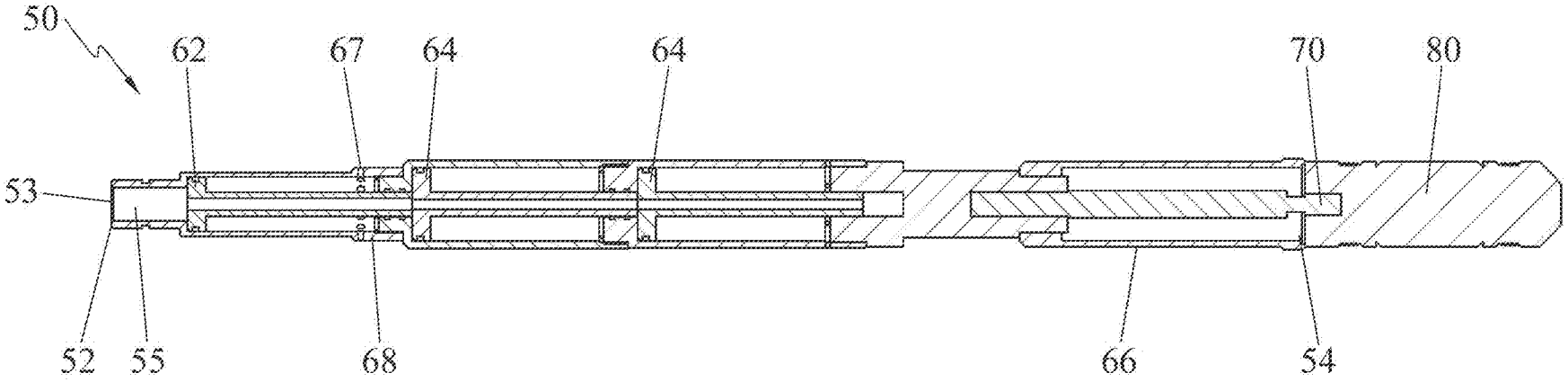
FIG. 6 is a schematic view of an interior of the setting tool and bridge plug shown in FIG. 5.

Referring again to FIGS. 1 and 2, the setting tool 50 is used to set the bridge plug 80 in place in the well so that cement slurry can be flowed on top of the set bride plug 80 to set in place in the well and form a cement plug. Referring to FIGS. 5 and 6, the setting tool 50 can have: an upper end 52; a lower end 54; an inner passage 55; a series of pistons including a first piston 62 and additional pistons 64; setting sleeve 66; exhaust ports 67; an outer wall 68; and the shear stud 70.

The inner passage 55 can be oriented to pass generally axially through the setting tool 50, from an inlet 53 in the upper end 52 of the setting tool 50. A series of pistons 62, 64 can be provided in the inner passage 55 of the setting tool 50. These pistons 62, 64 can create the force on the setting sleeve 66 to set the bridge plug 80 in place in the well and then to shear the shear stud 70 to separate the bridge plug 80 that has been set in the well from the setting tool 50.

The upper end 52 of the setting tool 50 can be connected by the upper shear joint 40 to the cement tool 20 so that cement slurry that flows down from the cement tool 20 enters the inner passage 55 of the setting tool 50 at the upper end 52 of the setting tool 50.

A first piston 62 is positioned in the inner passage 55 of the setting tool 50 upstream from the additional pistons 64 so that cement slurry that enters the inner passage 55 of the setting tool 50 from the cement tool 20 will flow against this first piston 62. This first piston 62 will press against the additional pistons 64 in the series of pistons, displacing the first piston 62 and therefore the additional pistons 64 downwards as more and more cement slurry builds up against the first piston 62.

The series of pistons 62, 64 will be displaced downwards; engaging the setting sleeve 66 to press against the bridge plug 80, setting the bridge plug 80 and then eventually shearing the shear stud 70 to separate the bridge plug 80 from the setting tool 50.

Exhaust ports 67 can be provided in an outer wall 68 of the setting tool 50 to allow the inner passage 55 of the setting tool 50 to be in fluid communication with an annulus formed in between the outer wall 68 of the setting tool 50 and the bore of the well. These exhaust ports 67 can be provided in the inner passage 55 below where the first piston 62 will be in an initial top position of its stroke, but above where the first piston 62 will be in a bottom position of the stroke of the first piston 62.

In this manner, when the first piston 62 is initially its top position at the top of its stroke, the exhaust ports 67 are fluidly separated from cement in the inner passage 55 of the setting tool 50. However, when the first piston 62 is displaced downwards to its bottom position of its stroke, the exhaust ports 67 are uncovered by the first piston 62 and the inner passage 55 of the setting tool 50 is placed in fluid communication with the annulus between the setting tool 50 and the well bore. This will allow cement in the inner passage 55 of the setting tool 50 to flow out of the inner passage 55 of the setting tool 50 through the exhaust ports 67 and flow into the annulus of the well between the abandonment tool 10 and the well bore.

The setting tool 50 is connected to the bridge plug 80 by the shear stud 70. This shear stud 70 can be designed to shear at a second force so that if more force than this second force is applied to this shear stud 70, the shear stud 70 will separate causing the bridge plug 80 to separate from the setting tool 50. In one aspect, this second force that the shear stud 70 will shear and separate at is 18,000 lbs.

When the setting sleeve 66 of the setting tool 50 has been displaced downward enough to set the bridge plug 80 in the well bore, continued downward movement of the setting sleeve 66 can reach this second force and shear the shear stud 70; separating the bridge plug 80, that is now set in the well bore, from the setting tool 50.

By making the second force required to shear the shear stud 70 lower than the first force required to shear the upper shear joint 40, if the bridge plug 80 gets stuck in the well before it is in its desired position (i.e. snagged on the trip down the well), the abandonment tool 10 can be pulled up by the coiled tubing attached to the upper end of the cement tool 20 and the shear stud 70 will shear before the upper shear joint 40, allowing the setting tool 50 to remain with the abandonment tool 10 while the bridge plug 80 is separated while the setting tool 50 is pulled back up the well with the rest of the abandonment tool 10 instead of the setting tool 50 remaining with the stuck bridge plug 80 downhole in the well.

The bridge plug 80 is connected to the setting tool 50 the shear stud 70. The bridge plug 80 is set in the bore of the well by the setting tool 50 to bridge the bore of the well so that cement slurry poured on top of the bridge plug 80 will remain in place on top of the bridge plug 80 while the cement slurry sets and forms a cement plug in the well bore.

Figure 7:
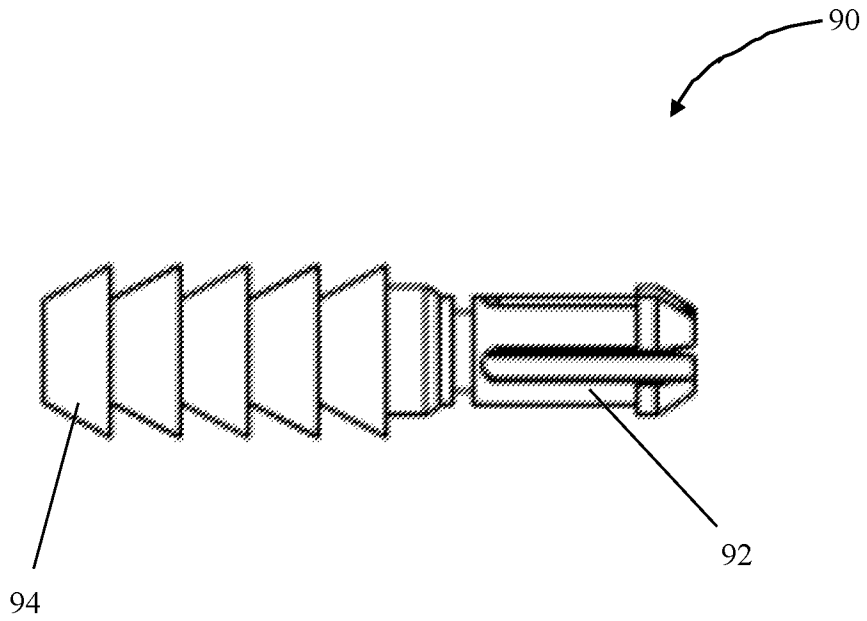
FIG. 7 is a side view of a dart.

Referring to FIG. 7, the dart 90 can have a latching mechanism 92 in the form of tabs to lock the dart 90 into place in the cement tool 20 and seals 94 to seal the inner passage 25 of the cement tool 20.

In operation, the dart 90 can be inserted in an end of coiled tubing and the upper end 22 of the cement tool 20 connected to a bottom end of the coiled tubing. Cement slurry can then be pumped up into the lower end 24 of the cement tool 20, up through the inner passage 25 of the cement tool 20 and into the coiled tubing behind the dart 90. The amount of cement slurry pumped into the coiled tubing can be based on the amount of cement needed for the cement plug. With the cement slurry in the coiled tubing and the cement plug 20, the setting tool 50 can be attached below the cement tool 20 by the upper shear joint 40 and the bridge plug 80 can be attached below the setting tool 50 by the shear stud 70 to form the abandonment tool 10.

The check valve 36 will allow cement slurry to be pumped up the inner passage 25 in the cement tool 20, but will stop the cement slurry from falling out of the coiled tubing and the cement tool 20, allowing the setting tool 50 to be attached to the cement tool 20 and preventing the cement slurry in the coiled tubing and inner passage 25 of the cement tool 20 from flowing into the inner passage 55 of the setting tool 50.

The entire abandonment tool 10, attached to the coiled tubing, can be lowered downhole in the well by the coiled tubing, until the abandonment tool 10 reaches the depth where the cement plug is desired. Once the abandonment tool 10 is in the desired position down the well, the coiled tubing can be pressurized so that the cement slurry in the bottom of the coiled tubing and the inner passage 25 of the cement tool 20 can be forced against the cement piston 33.

Referring to FIG. 4, when the cement tool 20 is attached to the coiled tubing, cement can flow down the coiled tubing and into the cement tool 20, where it will flow through the inner passage 25 in the cement tool 20 until it comes into contact with the cement piston 33. This cement piston 33 will prevent the cement slurry from flowing downwards into the rest of the abandonment tool 10. However, to allow the cement slurry to start flowing through the cement tool 20, the coiled tubing can be pressurized to a predetermined pressure, forcing the cement slurry in the inner passage 25 of the cement tool 20 against the cement piston 33 with enough force that the cement piston 33 will be forced downwards and, in turn, forcing the cement ports 35 to be displaced downwards.

When the pressurized cement slurry in the inner passage 25 of the cement tool 20 has displaced the cement piston 33 and therefore the cement ports 35 downwards enough that the cement ports 35 align with the cement drains 34 in the cement drain sleeve 39. Cement slurry in the coiled and the inner passage 25 of the cement tool 20 can now flow out of the inner passage 25 of the cement tool 20 and into the annulus 37 formed between the exterior of the cement drain sleeve 39 and the inner surface of the outer sleeve 38 of the cement tool 20. This cement slurry will flow out the cement ports 35, through the annulus 37 and out the lower end 24 of the cement tool 20.

Figure 8:
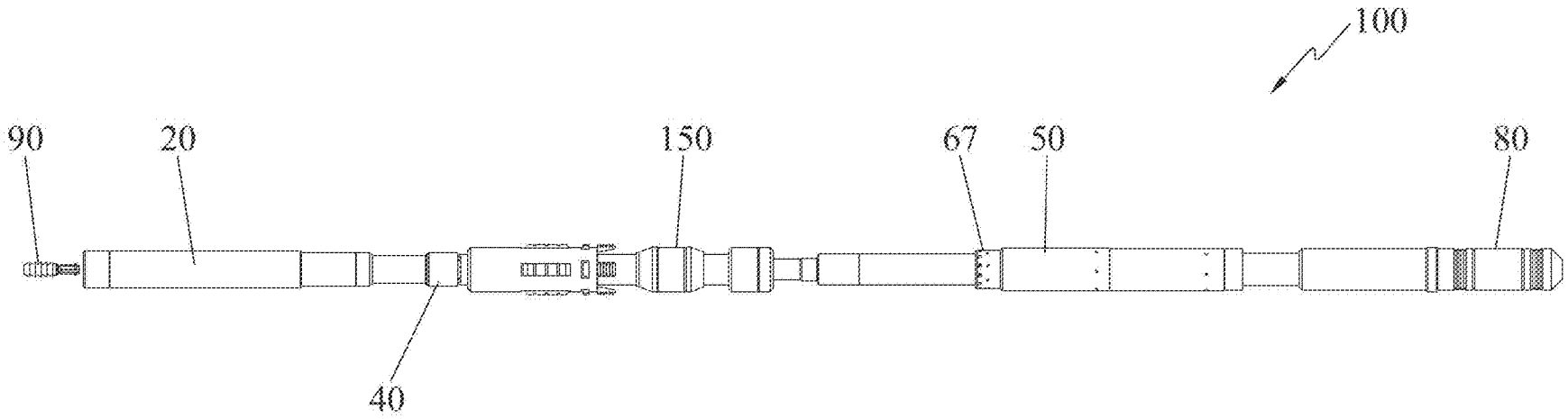
FIG. 8 is a side view of an abandonment tool for placing a cement plug downhole in a well where there are multiple zones and the cement plug is for a lower zone.

Referring again to FIGS. 1 and 2, the cement slurry that flows out of the lower end 24 of the cement tool 20 will flow through the upper shear joint 40 and into the upper end 52 of the setting tool 50. Referring to FIG. 8, the cement slurry inside the setting tool 50 will flow through the inner passage 55 of the setting tool 50 and up against the first piston 62 in the series of pistons 62, 64 in the setting tool 50.

When the force of the cement slurry against the first piston 62 reaches a predetermined force, the force of the cement against the first piston 62 will start stroking the setting tool 50. As the first piston 62 continues to be displaced downwards with the force of the cement slurry against the first piston 62, the first piston 62 will be displaced downwards from its initial top position and will in turn displace downwards the additional pistons 64 in the series of pistons. As the series of pistons all move downwards, the setting sleeve 66 will be forced against the bridge plug 80, which the shear stud 70 will pull back on the bridge plug 80 causing the bridge plug 80 to bridge the well bore. As the setting sleeve 66 continues to be forced downwards by the displacement of the series of the pistons 62, 64 in the setting tool 50, the force of the setting sleeve 66 on the bridge plug 80 will eventually be greater than the second force for the shear stud 70 and the shear stud 70 will shear, separating the bridge plug 80 from the setting tool 50.

With the bridge plug 80 separated from the setting tool 50, the series of pistons 62, 64 and specifically the first piston 62 can be displaced to its bottom position, exposing the exhaust ports 67 in the setting tool 50 and allowing cement slurry in the inner passage 55 of the setting tool 50 to flow out of the setting tool 50 and into the annulus formed between the setting tool 50 and the bore of the well. In this annulus, the cement slurry can flow downwards around the outside of the setting tool 50 and on top of the bridge plug 80 that is set in the well.

The bridge plug 80 can hold this cement in place in the well until it sets forming a cement plug to permanently seal the well.

Referring again to FIG. 2, as the cement drains out of the abandonment tool 10 and the coiled tubing, the dart 90 will move down the coiled tubing and eventually into the cement tool 20. Referring to FIG. 4, the dart 90 can follow the cement slurry into the abandonment tool 10 and specifically the cement tool 20 until the dart seats in the inner passage 25 of the cement tool 20 in the dart seat 95. With the dart 90 seated in the dart seat 95 of the cement tool 20, the dart 90 will isolate the cement ports 35 from the inner passage 25 of the cement tool 20 allowing the coiled tubing to be pressurized. As the pressure in the coiled tubing builds, the force on the dart 90 can shift the circulation sleeve 26 downwards when the pressure reaches a predetermined force on the dart 90. In one aspect, this predetermined force might be 900 psi.

When the circulation sleeve 26 has shifted far enough downwards, the circulation sleeve 26 can expose the circulation ports 31 passing through the circulation sub 30. The exposed circulation ports 31 will place the interior passage 25 of the cement tool 20 in fluid communication with the annulus 37. From this annulus 37, the pressurized fluid from the coiled tubing can flow into the setting tool 50 and out through the exhaust ports 67 in the setting tool 50 and into the well bore.

With the interior of the coiled tubing now being in fluid communication with the annulus of the well bore surrounding the abandonment tool 10, the cement plug can be tested. The coiled tubing and therefore the well bore can be pressurized to 1000 psi for 10 minutes to test the cement plug.

Once the testing is done, the pressure can be bled off, the dart 90 is latched into the cement tool 20 by the dart seat 95 and the latching mechanism 92 to prevent the dart 90 travelling back up the well with the pressure bleed off.

Once the pressure is bled off, the abandonment is done and the abandonment tool 10 can be pulled back up the well. The cement plug will eventually set, permanently sealing the well.

The abandonment tool 10 can be used when there are no zones in the well above where the cement plug will be installed so that the bore of the entire well can be pressurized above the installed cement plug to test it. However, if there are zones above the location where the cement plug will be placed in the well, the abandonment tool 10 may not be able to pressurize the well to test the newly placed cement plug without the pressure being bled off into these higher zones. Instead, a different abandonment tool provided with a packer can be used to install a cement plug below a zone in a well.

Figure 12:
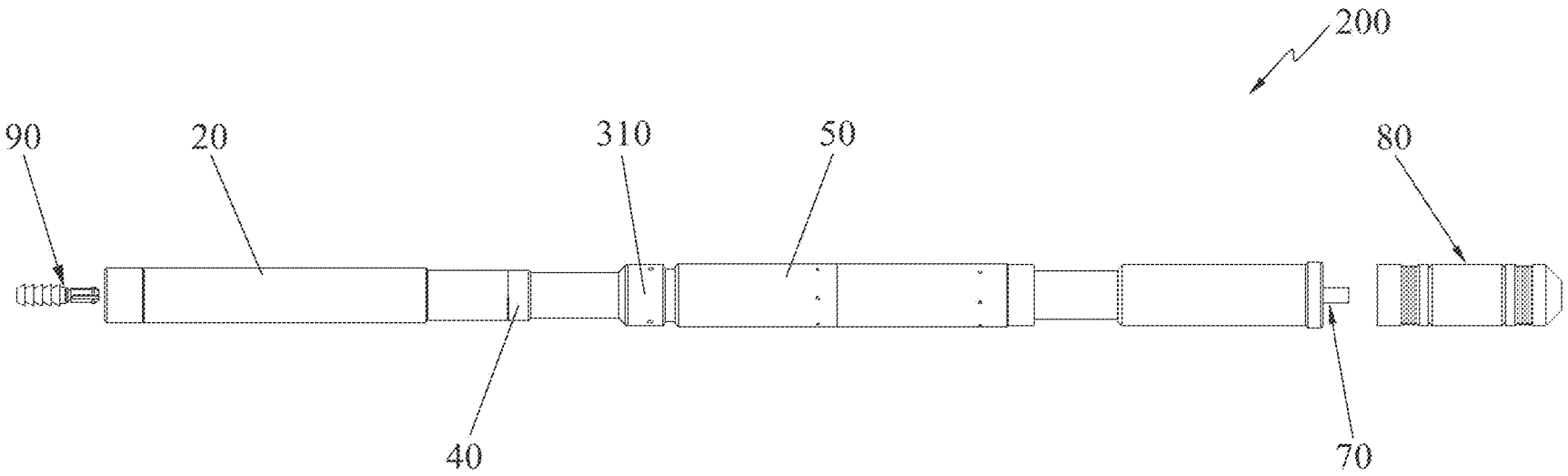
FIG. 12 is a side view of an abandonment tool having a tubing drain.

Referring to FIG. 12, an abandonment tool 200 can be used that includes a tubing drain 200 used to cover the exhaust ports. The abandonment tool 200 can be similar to abandonment tool 10, however, the tubing drain 310 is used to cover the exhaust ports, similar to the exhaust ports 67 of the abandonment tool 10. After the bridge plug 80 is set and separated from the setting tool 50, the cement in the inner passage of the setting tool 20 must be pressurized to place enough force on the tubing drain 310 before the tubing drain 310 will uncover the exhaust ports and allow cement to flow from the inner passage and out into the annulus of the well.

In this manner, the after the bridge plug 80 is set in the well, the bridge plug 80 can be pressure tested before the cement slurry is dumped on top of the bridge plug 80 to create the concrete plug. The well can be filled with water in the annulus and pressure tested from the surface. If the bridge plug 80 withstands the pressure testing, the water can be bled off and the cement slurry in the coiled tubing can be pressurized until it has enough force on the tubing drain 310 for the tubing drain 310 to uncover the exhaust ports. With the exhaust ports uncovered, cement slurry from the inner passage can flow out of the exhaust ports on the setting tool 50 and cover the bridge plug 80 to dry and set; creating a cement plug.

Figure 9:
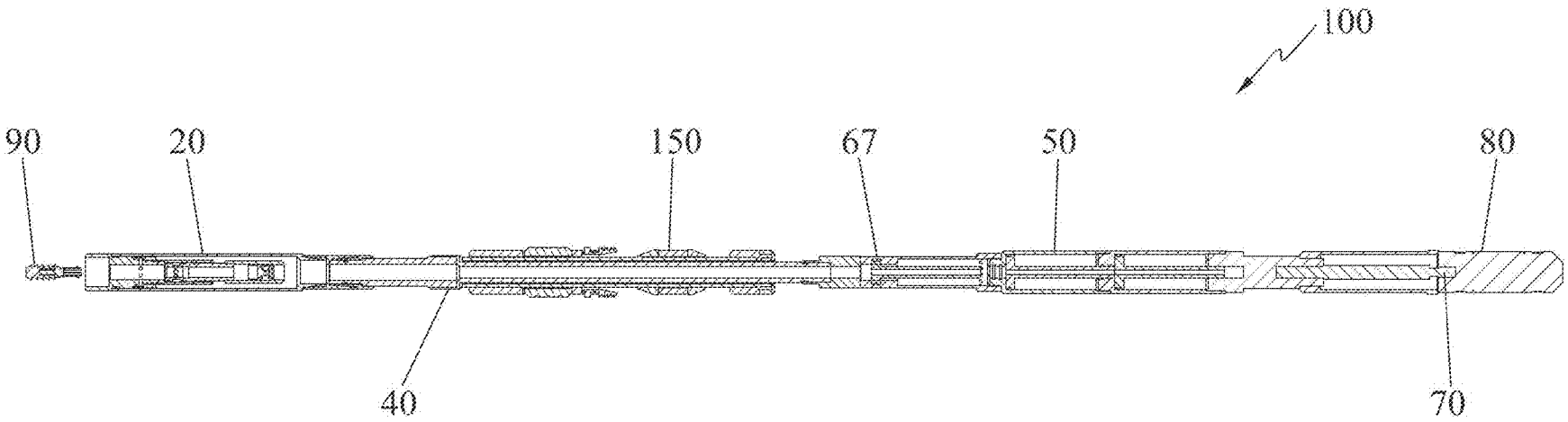
FIG. 9 is a schematic view of an interior of the abandonment tool of FIG. 8 showing the interior of the abandonment tool.

FIGS. 8 and 9 illustrate an abandonment tool 100 that can be used when there are multiple zones in a well that are to be sealed off with different cement plugs at different heights in the well. The abandonment tool 100 can be similar to abandonment tool 10, however, a packer 150 is added to fluidly isolated a section of the well so that a cement plug that has been paced in the well by the abandonment tool 100 can be pressure tested without the pressurized fluid escaping into a higher zone. The abandonment tool 100 can be used to set the lowest cement plug first, with the packer used to isolate the portion of the well above the cement plug from a higher reservoir. When this lowest cement plug is in place, this abandonment tool 100 can be used to set a higher cement plug above the next highest zone. When there are no more zones above the well, the abandonment tool 10 shown in FIGS. 1 and 2 can be used to set the last cement plug above the highest zone.

The abandonment tool 100 contains similar components to abandonment tool 10, in that the abandonment tool 100 can contain: a cement tool 20; an upper shear joint 40; a setting tool 50; a stud 70; a bridge plug 80; and a dart 90. However, the abandonment tool 100 also contains a packer 150.

Figure 10:
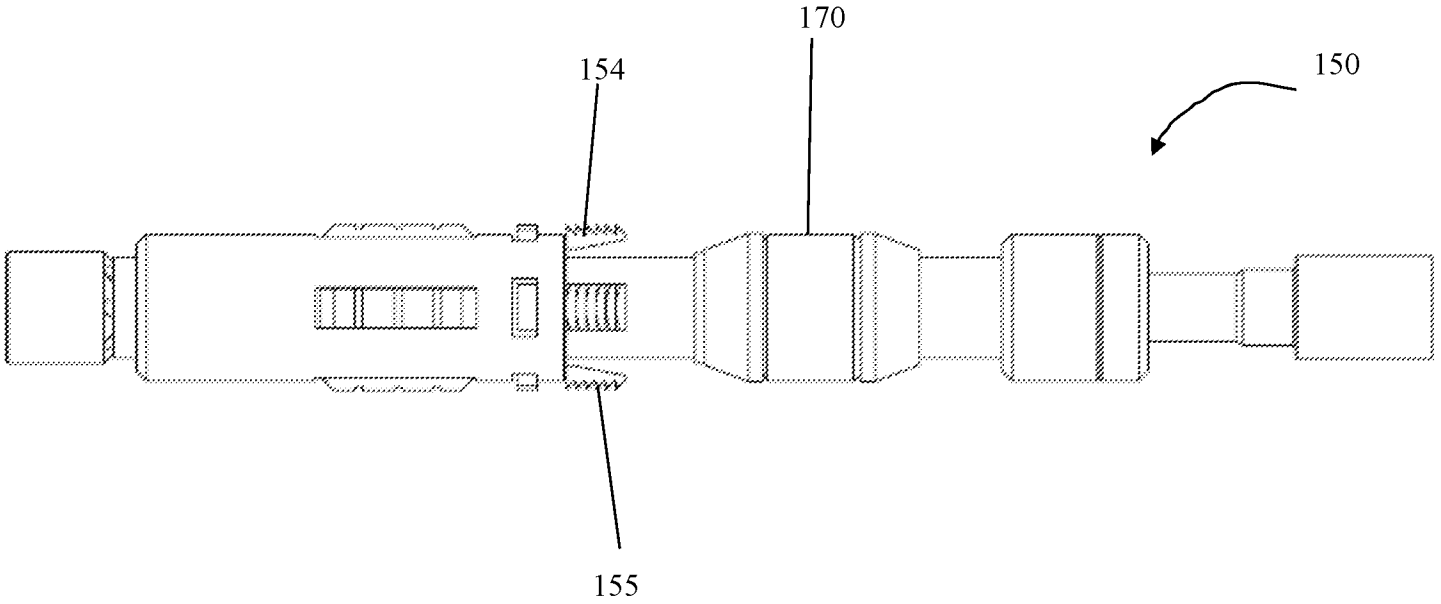
FIG. 10 is a side view of a packer.
Figure 11:
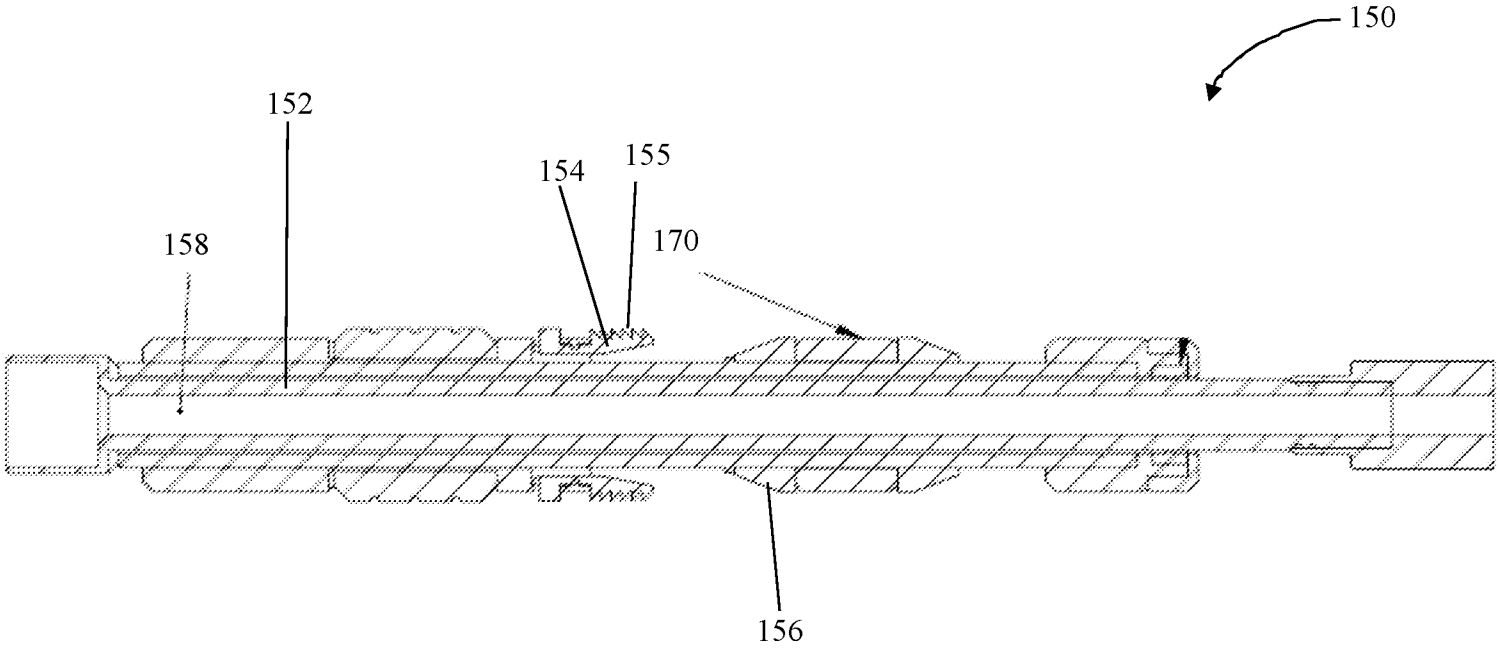
FIG. 11 is a schematic view of an interior of the packer shown in FIG. 10.

Referring to FIGS. 10 and 11, the packer 150 can be used to isolate the well bore above the cement plug to the packer 150 from any zones above the packer 150. The packer 150 can have an equalizer mandrel 152; slips 154; a cone 156; a flow passage 158 and a packer element 170.

The equalizer mandrel 152 carries the other elements of the packer 150 and has a flow passage 158 passing axially through the equalizer mandrel 152.

The slips 154 are provided on the outside of the equalizer mandrel 152 with outward facing teeth 155 for gripping a casing wall of a well and holding the packer 150 and therefore the abandonment tool 100 in place in the well. The cone 156 is angled to match the back of the slips 154 and force the slips 154 outwards against the wall of the well as the cone 156 and packer element 170 move towards the slips 154.

When the slips 154 are in place, anchoring the packer element 170 in place in the well, the packer element 170 can be energized and the packer element 170 expanded against the walls of the casing to isolate the annulus of the well below the packer element 170 from the annuls of the well above the packer element 170.

In this manner, the annulus in the well between the packer element 170 and the cement plug installed in the well can be isolated so that this section of the well can be pressurized using the circulation sub 30 of the cement tool 20 to test the cement plug that was just installed in the well by the abandonment tool 100.

In operation, the abandonment tool 100 can operate similar to the abandonment tool 10, but the packer 150 can be used after the cement slurry is placed on top of the bridge plug 80 by the abandonment tool 100 to isolate the annulus of the well around the abandonment tool 100 and the well bore.

To use the abandonment tool 100, the dart 90 can be inserted in an end of coiled tubing and cement slurry pumped up into the coiled tubing behind the dart 90. The amount of cement slurry pumped into the coiled tubing can be based on the amount of cement needed for the cement plug. With the cement slurry in the coiled tubing, the abandonment tool 100 can be attached to the end of coiled tubing by attaching the upper end 22 of the cement tool 20 to the end of the coiled tubing so that the hollow inner passage of the coiled tubing is in fluid communication with the inner passage 25 of the cement tool 20.

The packer 150 can be attached below the cement tool 20 by the upper shear joint 40 and the packer 150 attached to the upper shear joint 40. The setting tool 50 can be attached below the packer 150. The bridge plug 80 can be connected to the bottom of the setting tool 50 by the shear stud 70.

The entire abandonment tool 100, attached to the coiled tubing, can be lowered downhole in the well by the coiled tubing, until the abandonment tool 100 reaches the depth where the cement plug is desired. Referring to FIG. 4, the coiled tubing can be pressurized so that the cement slurry in the bottom of the coiled tubing and in the cement tool 20 can be forced against the cement piston 33 until the cement piston 33 is forced downwards exposing the cement ports 35.

With the cement ports 35 exposed, cement slurry can flow out of the inner passage 25 of the cement tool 20 and flow into the annulus 37 formed between the exterior of the cement drains 34 and the outer sleeve 38 of the cement tool 20. This cement slurry will flow out the cement ports 35, through the annulus 37 and out the lower end 24 of the cement tool 20 and into the packer 150.

Referring again to FIGS. 8 and 9, the cement slurry that flows out of the lower end 24 of the cement tool 20 will flow through the flow passage 158 in the packer 150 and into the setting tool 50. Referring to FIG. 6, the cement slurry inside the setting tool 50 will flow through the inner passage 55 of the setting tool 50 and up against the first piston 62 in the series of pistons in the setting tool 50.

The cement slurry will set the bridge plug 80 and then the bridge plug 80 is sheared off from the bottom of the abandonment tool 100 by the shear stud 70.

With the bridge plug 80 sheared off the bottom of the setting tool 50, the series of pistons in the setting tool 50 can continue to be displaced downwards by the cement slurry until the exhaust ports 67 in the setting tool 50 are exposed and the cement slurry can exit the setting tool 50 to flow down the annulus formed between the setting tool 50 and the bore of the well to the top of the bridge plug 80 that is set in the well.

The bridge plug 80 can hold this cement in place in the well until it sets; forming a cement plug to permanently seal the well.

Referring again to FIG. 9, as the cement drains out of the abandonment tool 10 and the coiled tubing, the dart 90 will move down the coiled tubing and eventually into the cement tool 20.

Referring again to FIGS. 10 and 11, the packer 150 can be used to set the packer element 170 against the walls of the well and isolate the annulus of the well around the lower portion of the abandonment tool 100 between the packer 150 and the packer element 170 and the newly placed cement plug.

With the well isolated between the packer 150 of the abandonment tool 100 and the newly placed cement plug, the pressure in the coiled tubing can force on the dart 90 and shift the circulation sleeve 26 downwards until the circulation ports 31 passing through the circulation sub 30 are exposed. The exposed circulation ports 31 will place the interior passage 25 of the cement tool 20 in fluid communication with the annulus 37. From this annulus 37, the pressurized fluid from the coiled tubing can flow into the packer 150, through the packer 150 and into the setting tool 50 where the pressurized fluid can exit the setting tool 50 through the exhaust ports 67 and into the annulus of the well surrounding the bottom of the abandonment tool 100.

Because the packer element 170 of the packer 150 will fluidly isolate the well between the packer 150 and the newly placed cement plug, preventing the pressurized fluid from travelling up the well and escaping into a higher zone, this pressurized fluid can pressurize this portion of the well and allow the newly placed cement plug to be tested. The coiled tubing and therefore the well bore between the packer 150 and the newly placed cement plug can be pressurized to 1000 psi for 10 minutes to test the cement plug.

Once the testing is done, the pressure can be bled off, the dart 90 is latched into the cement tool 20 by the dart seat 95 and the latching mechanism 92 to prevent the dart 90 travelling back up the well with the pressure bleed off.

Once the pressure is bled off, the packer 150 can be disengaged with the walls of the well. The abandonment tool 100 can be pulled back up the well and the cement plug will eventually set, permanently sealing the well. The abandonment tool 100 can then be used to set the next higher cement plug, of if there is only one more cement plug to be set, the abandonment tool 10 can be used to set the last cement plug.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. An abandonment tool for abandoning a well comprising:

a cement tool connectable to coiled tubing for controlling a flow of a cement slurry through the abandonment tool;

a setting tool provided below the cement tool;

an upper shear joint connected below the cement tool and above the setting tool, the upper shear joint shearing at a first force to separate the cement tool and the setting tool;

a bridge plug for plugging the well, the bridge plug settable by the setting tool;

a shear stud connecting the bridge plug to a bottom end of the setting tool, the shear stud shearing at a second force to separate the bridge plug from the setting tool; and at least one exhaust port in an inner passage in the abandonment tool to place the inner passage in fluid communication with an annulus between the abandonment tool and a wall of the well after the bridge plug has plugged the well, wherein the second force is lower than the first force; and wherein the cement tool comprises:

an upper end connectable to the coiled tubing;

a lower end;

an outer sleeve forming an outer surface of the cement tool;

an inner passage running axially through the cement tool with an inlet in the upper end of the cement tool;

a cement drain sleeve having at least one cement drain;

an annulus formed between an exterior of the cement drain sleeve and an inner surface of the outer sleeve, the annulus in fluid communication with an outlet in the lower end of the cement tool; and a cement piston provided in the inner passage and having at least one cement port in fluid communication with the inner passage, the cement piston displaceable from an initial top position to a bottom position, wherein when the cement piston is in the initial top position the cement drain sleeve covers the at least one cement port and when the cement position is displaced to the bottom position, the at least one cement port aligns with the at least one cement drain, placing the inner passage of the cement tool in fluid communication with the annulus.

2. The abandonment tool of claim 1 further comprising a check valve positioned below the at least one cement drain.

3. The abandonment tool of claim 1 further comprising:

a dart;

a circulation sub provided at the upper end of the cement tool with the inner passage passing through the circulation sub, the circulation sub having a dart seat for receiving the dart and at least one circulation port in the inner passage;

a circulation sleeve covering the at least one circulation port and displaceable downwards by applying pressure to the dart, when the dart is in the dart seat, to expose the at least one circulation port and place the inner passage in fluid communication with the annulus.

4. The abandonment tool of claim 3 wherein the dart comprises a latching mechanism to latch the dart into the dart seat and at least one seal to seal the inner passage of the cement tool when the dart is positioned in the dart seat.

5. The abandonment tool of claim 1 wherein the first force is 20,000 lbs.

6. The abandonment tool of claim 1 wherein the second force is 18,000 lbs.

7. The abandonment tool of claim 1 further comprising a packer for expansion against a wall of the well to fluidly isolate an annulus of the well below the packer from an annulus of the well above the packer.

8. The abandonment tool of claim 7 wherein the packer comprises:

an equalizer mandrel;

an expandable packer element provided on the equalizer mandrel;

slips provided on the outside of the equalizer mandrel, the slips having outward facing teeth;

a cone provided on the equalizer mandrel to force the slips against the wall of the well when the cone is moved towards the slip; and a flow passage passing axially through the equalizer mandrel.

9. The abandonment tool of claim 7 wherein the packer is connected between the upper shear joint and the setting tool.

10. The abandonment tool of claim 1 wherein the setting tool is connected to a bottom of the upper shear joint.

* * * * *